US005215839A

United States Patent [19]

Yu

[11] Patent Number: 5,215,839

[45] Date of Patent: Jun. 1, 1993

[54] METHOD AND SYSTEM FOR REDUCING SURFACE REFLECTIONS FROM AN ELECTROPHOTOGRAPHIC IMAGING MEMBER

[75] Inventor: Robert C. U. Yu, Webster, N.Y.

[73] Assignee: Xerox Corporation, Stamford, Conn.

[21] Appl. No.: 812,540

[22] Filed: Dec. 23, 1991

[51] Int. Cl.[5] ..... G03G 5/14

[52] U.S. Cl. ..... 430/58; 430/62; 430/63; 430/131

[58] Field of Search ..... 430/56, 57, 63, 64, 430/58, 59, 62, 131

[56] References Cited

U.S. PATENT DOCUMENTS 4,588,667 5/1986 Jones et al. ..... 430/73

4,618,552 10/1986 Tanaka et al. ..... 430/60

4,786,570 11/1988 Yu et al. ..... 430/58

5,008,167 4/1991 Yu ..... 430/56

5,096,795 3/1992 Yu ..... 430/58

*Primary Examiner*—John Goodrow

[57] ABSTRACT

A layered electrophotographic imaging member is modified to reduce the effects of interference within the member caused by reflections from coherent light incident on a ground plane. The modification described is to form an interface layer between a blocking layer and a charge generation layer, the interface layer comprising a polymer having incorporated therein filler particles of synthetic silica or mineral particles. A preferred material is aerosil silica from 10 to 80% by weight. The filler particles scatter the light preventing reflections from the ground plane back to the light incident surface.

7 Claims, 5 Drawing Sheets

METHOD AND SYSTEM FOR REDUCING SURFACE REFLECTIONS FROM AN ELECTROPHOTOGRAPHIC IMAGING MEMBER

BACKGROUND AND MATERIAL DISCLOSURE STATEMENT

The present invention relates to an imaging system using coherent light radiation to expose a layered member in an image configuration and, more particularly, to an imaging member which has been modified to reduce optical interference occurring within said photosensitive member which results in a plywooding type of defect in output prints.

There are numerous applications in the electrophotographic art wherein a coherent beam of radiation, typically from a helium-neon or diode laser, is modulated by an input image data signal. The modulated beam is directed (scanned) across the surface of a photosensitive medium. The medium can be, for example, a photoreceptor drum or belt in a xerographic printer, a photosensor CCD array, or a photosensitive film Certain classes of photosensitive medium which can be characterized as "layered photoreceptors" have at least a partially transparent photosensitive layer overlying a conductive ground plane. A problem inherent in using these layered photoreceptors, depending upon the physical characteristics, is an interference effectively created by two dominant reflections of the incident coherent light on the surface of the photoreceptor; e.g., a first reflection from the top surface and a second reflection from the bottom surface of the relatively opaque conductive ground plane. This condition is shown in FIG. 1: a coherent beam is incident on a layered photoreceptor 6 comprising a charge transport layer 7, charge generator layer 8, and a ground plane 9. The interference effects can be explained by following two typical rays of the incident illumination. The two dominant reflections of a typical ray 1, are from the top surface of layer 7, ray A, and from the top surface of ground plane 9, ray C. The transmitted portion of ray C, ray E, combines with the reflected portion of ray 2, ray F, to form ray 3. Depending on the optical path difference as determined by the thickness and index of refraction of layer 7, the interference of rays F and E can be constructive or destructive when they combine to form ray 3. The transmitted portion of ray 2, ray G, combines with the reflected portion of ray C, ray D, and the interference of these two rays determines the light energy delivered to the generator layer 8. When the thickness is such that rays E and F undergo constructive interference, more light is reflected from the surface than average, and there will be destructive interference between rays D and G, delivering less light to generator layer 8 than the average illumination. When the transport layer 7 thickness is such that reflection is a minimum, the transmission into layer 8 will be a maximum. The thickness of practical transport layers varies by several wavelengths of light so that all possible interference conditions exist within a square inch of surface. This spatial variation in transmission of the top transparent layer 7 is equivalent to a spatial exposure variation of generator layer 8. This spatial exposure variation present in the image formed on the photoreceptor becomes manifest in the output copy derived from the exposed photoreceptor. The output copy exhibits a pattern of light and dark interference fringes which look like the grains on a sheet of plywood, hence the term "plywood effect" is generically applied to this problem.

In the prior art, various techniques are known for modifying the structure of the imaging member to reduce the second dominant reflection from the imaging member ground plane. U.S. Pat. No. 4,618,552 and co-pending application, U.S. Ser. No. 07/546,990, filed on Jul. 2, 1990 describe methods of roughening the surface of the ground plane to create a diffuse reflection of the light reflected therefrom. U.S. Ser. No. 07/541,655, filed on Jun. 21, 1990, discloses a roughening of the PET substrate upon which the ground plane is formed with the roughened surface replicated into the ground plane. U.S. Ser. No. 07/523,639, filed on May 15, 1990, and U.S. Ser. No. 07/552,200, filed on Jul. 13, 1990, disclose forming the ground plane or a layer over the ground plane of a transparent conductive material.

The present invention is directed towards eliminating the reflection from the ground plane by modifying the composition of an interface layer which lies between a silane blocking layer and a charge generator layer in a specific photoreceptor embodiment. Filler particles, such as synthetic silica, of a specific refractive index and size are incorporated into the interface layer. Examples are provided of preferred filler percentages by weight. More particularly, the present invention relates to an electrophotographic imaging member comprising, in sequence, a substrate having a conductive surface, a silane hole blocking layer, an adhesive interface layer, a charge generation layer comprising a film forming polymeric component and a hole transport layer, the imaging member characterized by said interface layer having incorporated therein filler particles, said particles comprising about 30 to 50% by weight of said layer.

DESCRIPTION OF THE INVENTION

Figure 1:
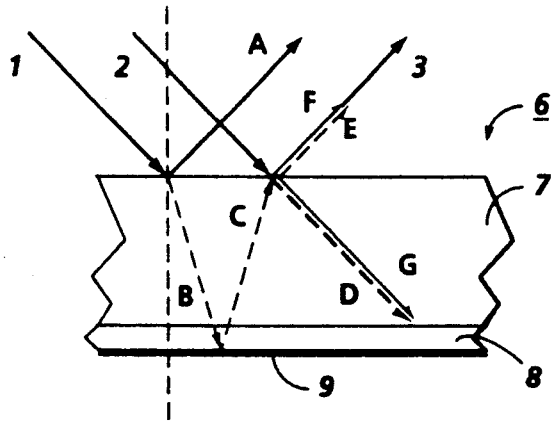
FIG. 1 PRIOR ART
FIG. 1 shows coherent light incident upon a prior art layered photosensitive medium leading to reflections internal to the medium.
Figure 2:
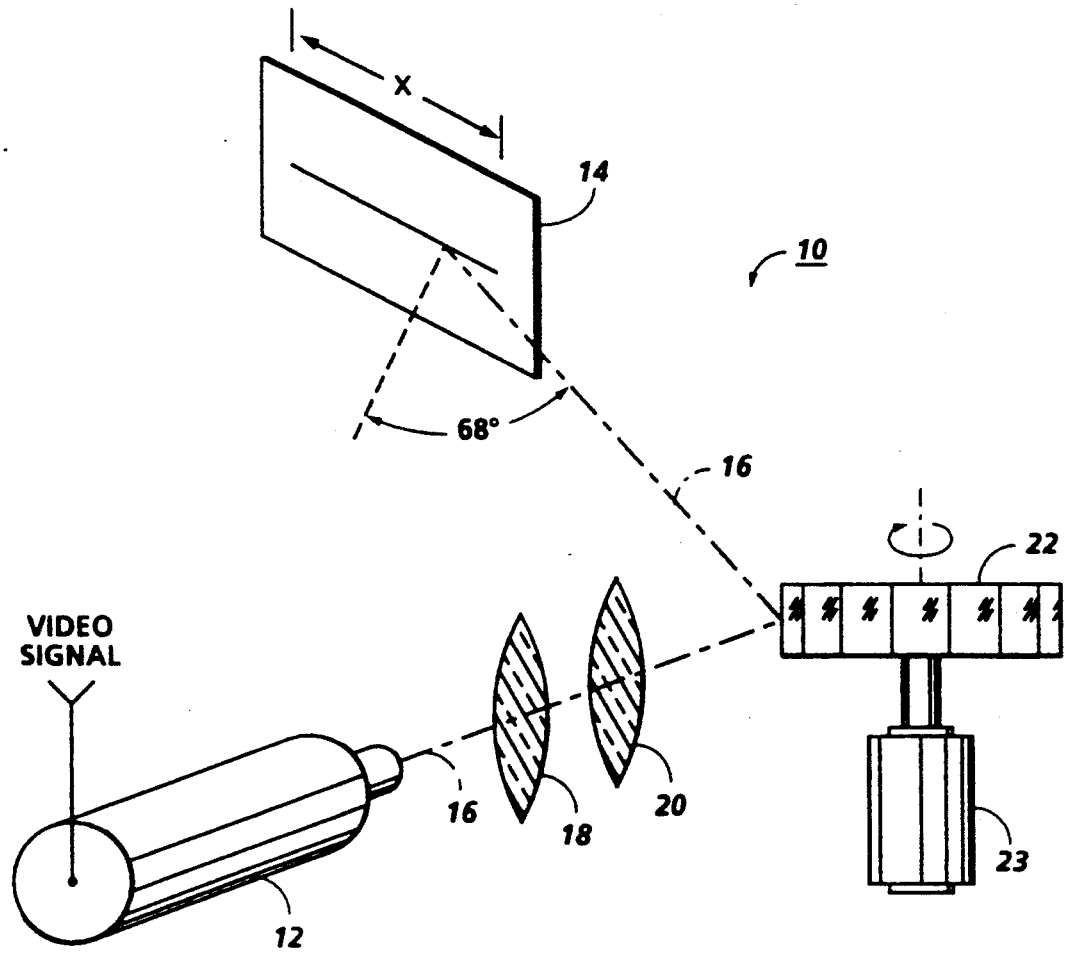
FIG. 2 is a schematic representation of an optical system incorporating a coherent light source to scan a light beam across a photoreceptor modified to reduce the interference effect according to the present invention.

FIG. 2 shows an imaging system 10 wherein a laser 12 produces a coherent output which is scanned across photoreceptor 14. Laser 12 is, for this embodiment, a helium neon laser with a characteristic wavelength of 0.63 micrometer, but may be, for example, an Al Ga As Laser diode with a characteristic wavelength of 0.78 micrometers. In response to video signal information representing the information to be printed or copied, the laser is driven in order to provide a modulated light output beam 16. The laser output, whether gas or laser diode, comprises light which is polarized parallel to the plane of incidence. Flat field collector and objective lens 18 and 20, respectively, are positioned in the optical path between laser 12 and light beam reflecting scanning device 22. In a preferred embodiment, device 22 is a multifaceted mirror polygon driven by motor 23, as shown. Flat field collector lens 18 collimates the diverging light beam 16 and field objective lens 20 causes the collected beam to be focused onto photoreceptor 14, after reflection from polygon 22. Photoreceptor 14 is a layered photoreceptor, but one which, in the prior art, has the structure shown in FIG. 3 and has been modified according to the invention shown in FIG. 4.

Figure 3:
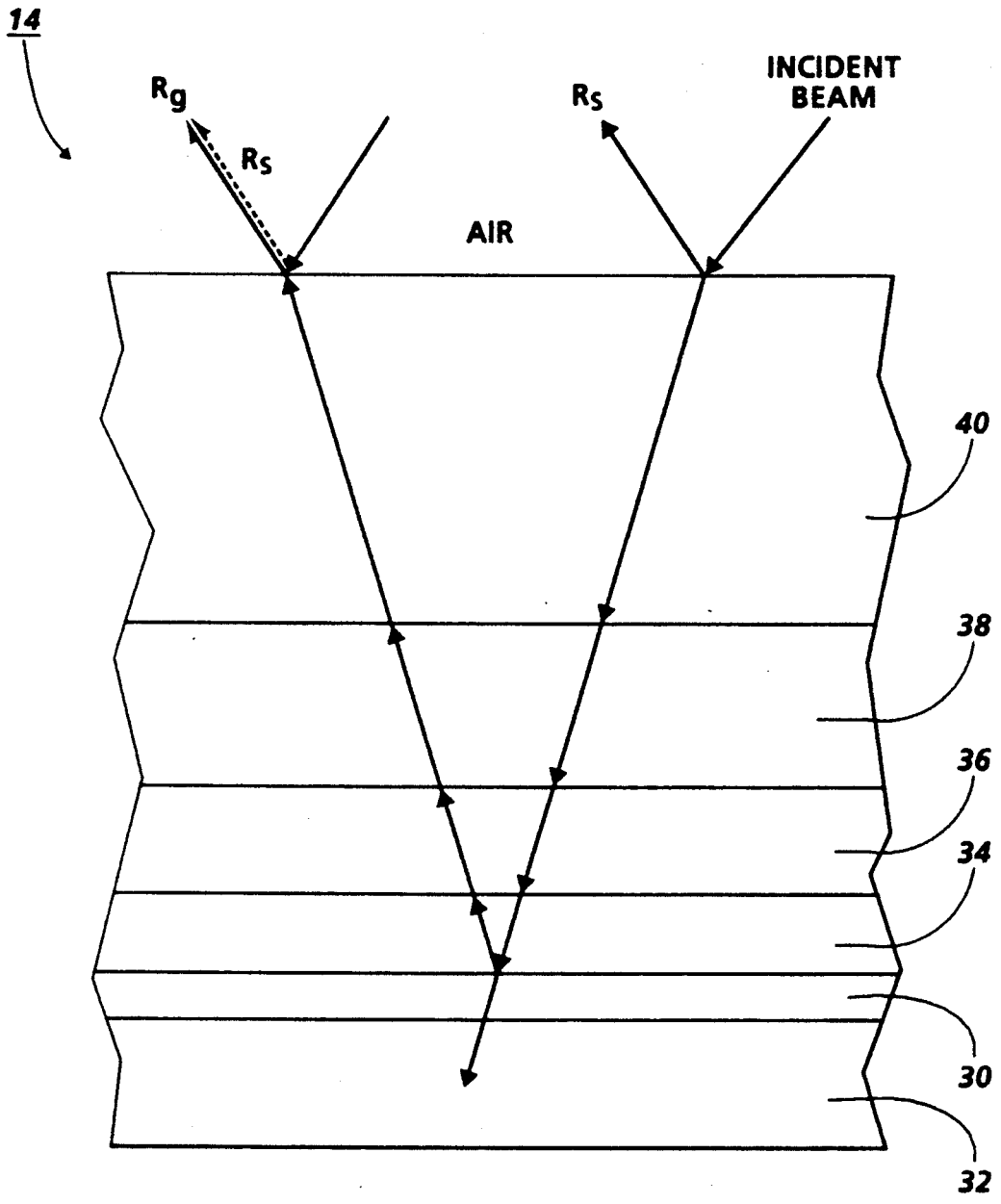
FIG. 3 PRIOR ART
FIG. 3 is a partial cross-sectional view of the photoreceptor of FIG. 2 with a conventional adhesive interface layer to illustrate the plywooding effect.

Referring to FIG. 3, photoreceptor 14 is a layered photoreceptor which includes a conductive ground plane 30 formed on a dielectric supporting substrate 32 (typically polyethylene terephthalate (PET)). As is conventional in the art, ground plane 30 has formed thereon a polysilane layer 34, whose function is to act as a hole blocking layer. Formed on top of blocking layer 34 is an interface layer 36. Layer 36, conventionally, is a polyester of the type generally described in U.S. Pat. No. 4,786,570, whose contents are hereby incorporated by reference. Polyesters of choice are copolyester 49K, copolyesters of Vitel PE-100, Vitel PE-200, Vitel PE-307, Vitel PE-5545, and the like. Other film forming polymers suitable for interface layer 36 application include PVC, polyurethane, polyacrylate, polyvinyl butyral, or the like. Layer 36 is shown in FIG. 3 in its prior art, unmodified form to contrast with the layer 36' of FIG. 4 which has been modified according to the invention by the addition of filler particles. Continuing with the description, charge generation layer 38 overlies layer 36 and charge or hole transport layer 40 overlies layer 38. Photoreceptor 14 is conventionally formed according to the teachings of U.S. Pat. No. 4,588,667, whose contents are hereby incorporated by reference.

The reflected beam is designated as $R_s$. As shown in FIG. 3, the incident light entering the charge transport layer 40 is bent, due to the refractive index difference between the air (having a value of 1.0) and layer 40 (having a value of 1.57). Since the refractive indexes of all the internal layers 34, 36, 38, and 40 are about the same, no significant internal refraction is expected and the light, therefore, travels in a straight line through these layers. Although the residual light energy (after large photon absorption by layer 38) that eventually reaches the thin ground plane 30 is partially transmitted through the ground plane, nonetheless, a greater fraction is reflected back to layer 40 and, designated as $R_g$, exits to the air. The emergence of the light energy $R_g$ from the photoreceptor 14 has direct interference with the reflected light $R_s$, resulting in the formation of the observed plywood fringes effect.

To eliminate the cause of the interference fringes, the present invention's intent is focused on developing a material modification approach such that light energy reflection from ground plane 30 is substantially suppressed to a point that $R_g$ can virtually be removed. To achieve this purpose, the concept of filler incorporation into the interface layer 38 to making it act like a light scattering center is presented.

Figure 4:
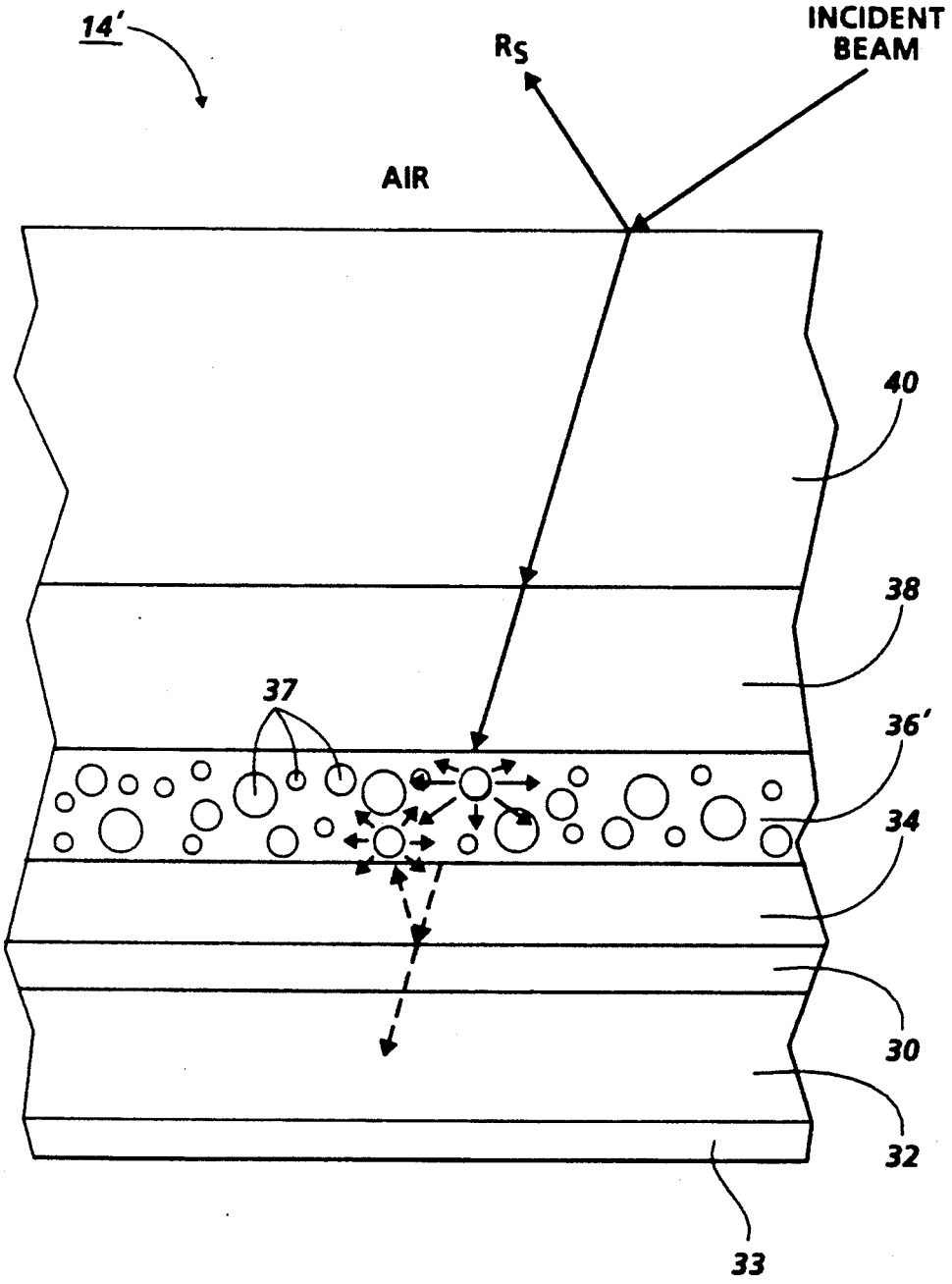
FIG. 4 is a partial cross-sectional view of the photoreceptor of FIG. 3 wherein the adhesive interface layer is modified by incorporating light scattering filler particles according to the present invention.

Referring now to FIG. 4, there is shown a preferred embodiment of the present invention. Photoreceptor 14' consists of a 3 ml. PET layer 32 with a 14μ anti-curl layer 33. Ground plane 30 is a 200A° Titanium coating. Silane layer 34 is a 500A° layer, charge generation layer 38 is a 2μ thick selenium/polyvinyl carbazole layer, and charge transport layer 40 is 24μ thick.

According to the invention, interface layer 36' is a copolyester, in a preferred embodiment, the copolyester 49K, approximately 2000 A° thick having incorporated therein a plurality of filler particles chosen to have a substantial refractive index mismatch from that of the 49K material matrix. As shown in this figure, the particles 37 serve to diffusely reflect the scattered light passing through the layer in either direction. Thus, the function of layer 36' as a linking layer between layer 34 and 38 has been enhanced by functioning also like an anti-reflecting coating to effectively remove the light interfering component $R_g$ (FIG. 3) from the photoreceptor surface. For satisfactory results, the interface layer 36' has a thickness generally ranging from about 500 A° to about 10,000 A°. Preferably, it is from about 1,000 A° to about 7,000 A° thick. However, the optimum functional thickness is between about 2,000 A° and about 5,000 A°.

Two classes of filler particles 37 of particular interest are:

1) Synthetic silica: includes precipitated silica, pyrogenic silica, aerogels and hydrogels. These types of silicas have refractive index values of approximately 1.42.

2) Mineral particles: includes titanium dioxide (both rutile and anatase forms, refractive index=2.0), zinc sulfide (refractive index=2.4), zirconium oxide and zircon (refractive index=2.1), barium sulfate (refractive index=1.65), calcium carbonate (refractive index=1.6), kaolinite (refractive index=1.56), calcium silicate (refractive index=1.65), sodium silico aluminate (refractive index=1.51), and the like.

To produce the best light scattering effect, the filler particles 37 selected for incorporation into layer 36' are preferred to have a refractive index of at least 0.05 greater (or smaller) than the value of the matrix polymer. Although filler loading from about 10% by weight to about 80% by weight is satisfactory, nevertheless a loading range between about 20% by weight and 60% by weight is preferred.

To investigate the effectiveness of filler incorporation in suppressing the plywood fringe development, four photoreceptor devices were fabricated as described in the following examples:

EXAMPLE 1

A photoreceptor 14 shown in FIG. 3, and as described in aforementioned U.S. Pat. No. 4,588,667, was prepared by following the standard fabrication procedures and using the same materials to serve as a control.

EXAMPLE 2

A second photoreceptor 14' was fabricated in the same manner, using the same materials described in Example 1, except that 30% weight aerosil silica was incorporated in the interface layer 36'. For a 49K interface layer coating solution having the aerosil silica addition, ball milling was carried out overnight using glass beads to provide good particle dispersion. Since the refractive index of the aerosil is 1.42 compared to the 1.59 refractive index value of the 49K polyester, a high silica level of loading is needed in order to produce adequate light scattering results.

EXAMPLE 3

A third photoreceptor was fabricated in the same manner, using the same materials described in Example 2, except that 40% weight aerosil silica was incorporated into the interface layer 36'.

EXAMPLE 4

A fourth photoreceptor was fabricated in the same manner, using the same materials described in Example 2, except that 50% weight aerosil silica was incorporated in layer 36'.

To evaluate the effectiveness of aerosil silica incorporation into the 49K interface layer 36', in suppressing the plywood fringes, the photoreceptors of Examples 1 to 4 were examined under a coherent light emitted from a low pressure sodium light source. In sharp contrast to the woodgrain patterns seen in the control photoreceptor sample of Example 1, no wood grain fringes were notable for the invention photoreceptor samples having 30, 40, and 50% weight levels of aerosil silica loading.

Figure 5:
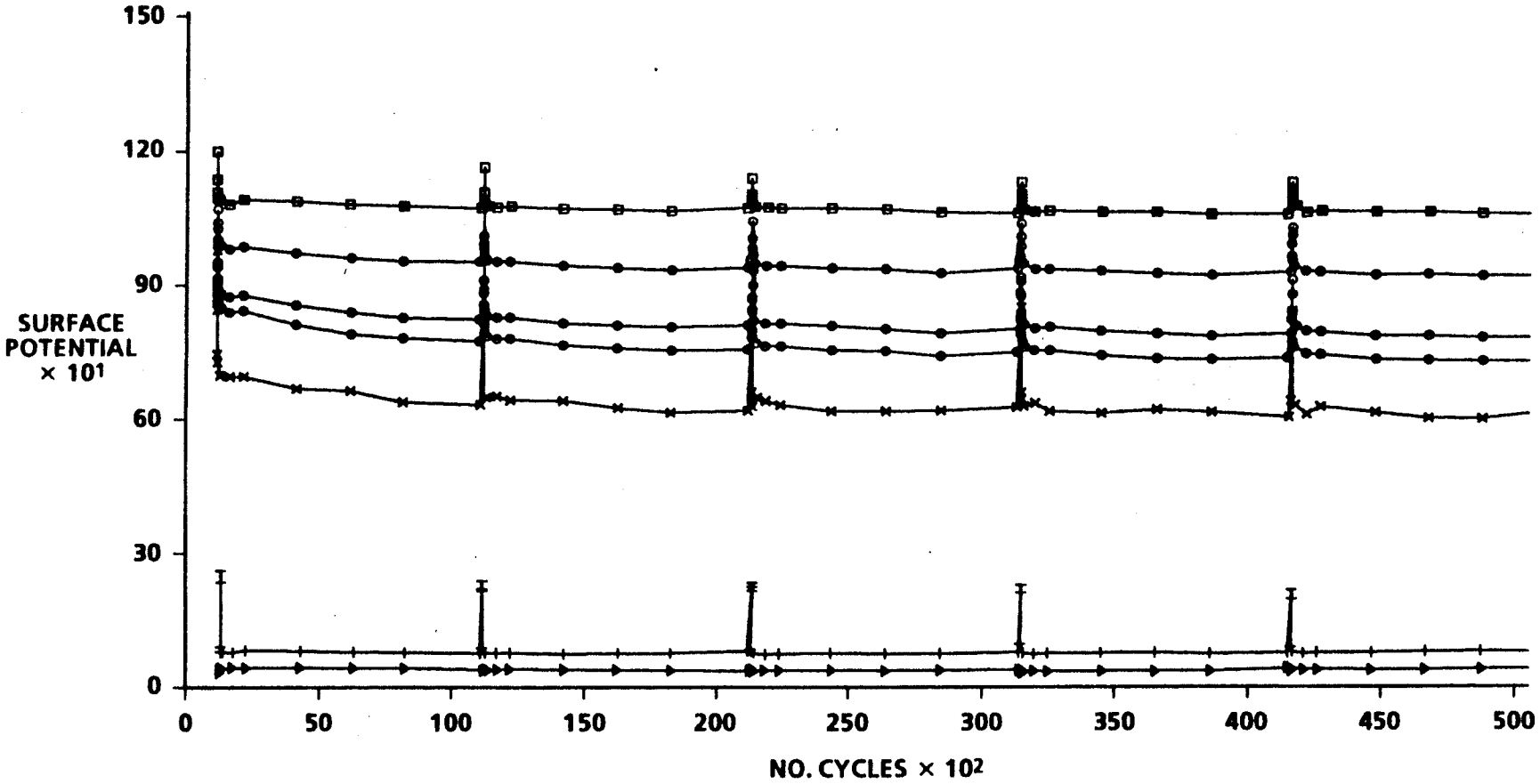
FIGS. 5 and 6 are graphs illustrating the electric cyclic stability of a standard photoreceptor control and a photoreceptor modified according to the present invention.
Figure 6:
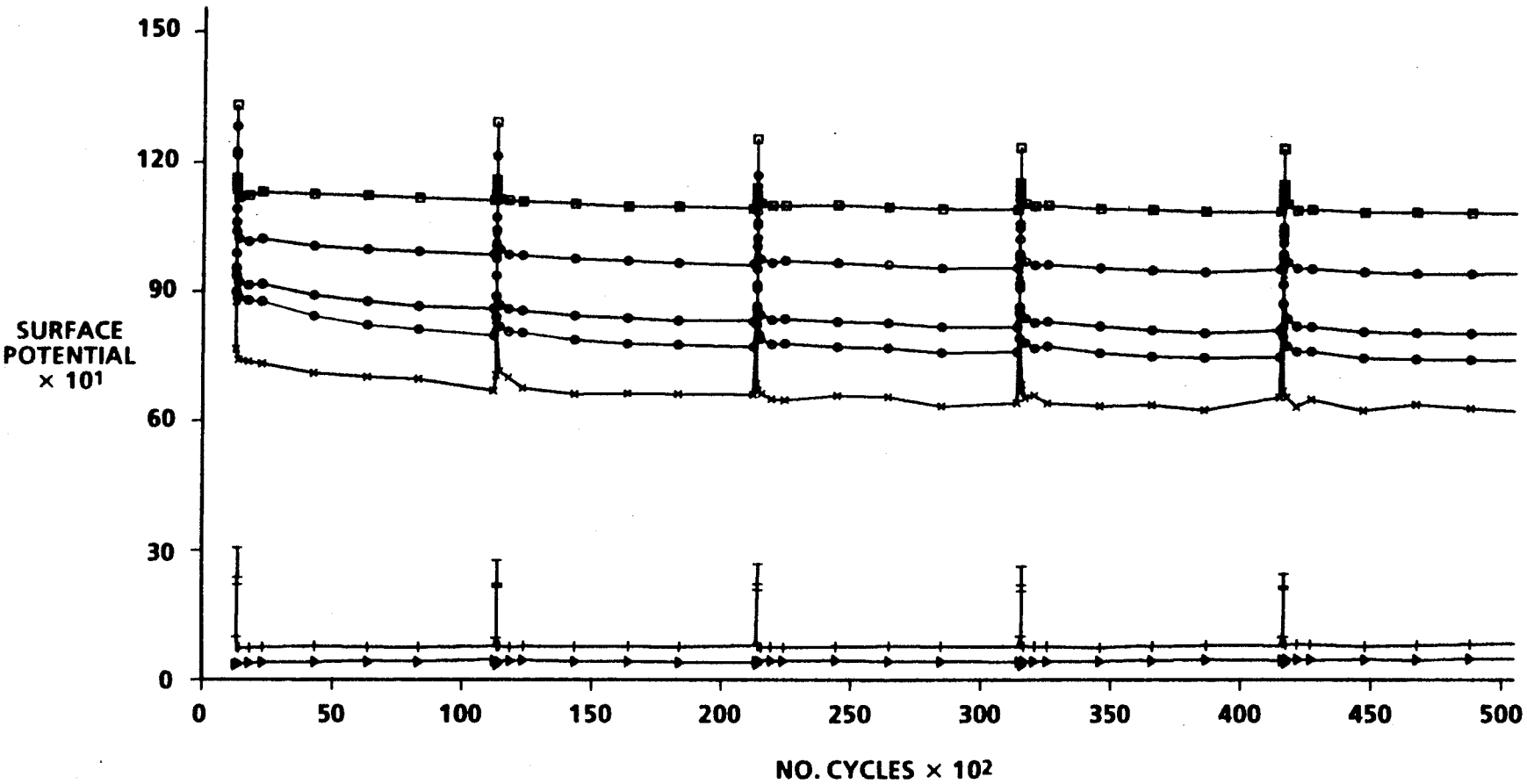

Addition of aerosil silica into the layer 36' has not been observed to produce negative impact on the adhesion properties of the layer. In fact, the 49K interface layer's adhesion was seen to be improved through the effect of filler reinforcement. Very importantly, the electrical properties of the control photoreceptor device were maintained after 30, 40, and 50% weight aerosil silica incorporation into the 49K interface layer. FIGS. 5 and 6 show the 50K electrical cyclic stabilities of the control photoreceptor device and the 50% weight aerosil silica loaded designs, respectively.

While the embodiment disclosed herein is preferred, it will be appreciated from this teaching that various alternative modifications, variations, or improvements therein may be made by those skilled in the art, which are intended to be encompassed by the following claims.

For example, photoreceptor 14', which is shown in a flat belt configuration, may also be formed in the cylindrical or drum configuration.

What is claimed is:

1. An electrophotographic imaging member comprising in sequence a substrate having a conductive surface, a silane hole blocking layer, an adhesive interface layer, a charge generation layer comprising a film forming polymeric component and a hole transport layer, the imaging member characterized by said interface layer having incorporated therein filler particles, said particles comprising about 10 to 80% by weight of said layer.

2. The imaging member of claim 1 wherein said particles are selected from the group consisting of precipitated silica, pyrogenic silica, aerogels, and hydrogels.

3. The imaging member of claim 1 wherein said particles are selected from the group consisting of titanium dioxide, zinc sulfide, zirconium oxide, zircon, barium sulfate, calcium carbonate, kaolinite, calcium silicate, and sodium silico aluminate.

4. The imaging member of claim 1 wherein the particles are incorporated into a polymer interface layer, the refractive index of the particles being in the order of 0.05 greater or smaller than the refractive index of the polymer.

5. A raster output scanning system comprising:

means for generating a beam of high intensity, modulated coherent light, and optical means for imaging said beam onto the surface of a photosensitive image recording medium, said recording medium comprising in sequence a supporting substrate having a conductive surface, a silane hole blocking layer, an adhesive interface layer, a charge generation layer comprising a film forming polymeric component and a hole transport layer, the imaging member characterized by said interface layer having incorporated therein filler particles, said particles comprising about 10 to 80% by weight of said layer.

6. A process for forming an electrophotographic imaging member comprising the steps of:

providing a dielectric supporting substrate, selectively depositing a conductive material onto the dielectric supporting substrate to form a ground plane, forming a silane blocking layer on a ground plane, and forming an adhesive interface layer onto said blocking layer, the interface layer comprising a polymer having incorporated therein 10 to 80% by weight of filler particles, and forming a charge generation layer over said interface layer and a charge transport layer on said charge generation layer.

7. The process of claim 6 wherein the filler particles have a refractive index in the order of 0.05 greater or smaller than the refractive index of the polymer.

* * * * *